US008986796B2

(12) United States Patent
Imakura et al.

(10) Patent No.: US 8,986,796 B2
(45) Date of Patent: Mar. 24, 2015

(54) THERMAL TRANSFER SHEET

(75) Inventors: Yuzu Imakura, Shinjuku-Ku (JP); Yasushi Yoneyama, Shinjuku-Ku (JP); Yusaku Akiyama, Shinjuku-Ku (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 33 days.

(21) Appl. No.: 14/001,019

(22) PCT Filed: Feb. 23, 2012

(86) PCT No.: PCT/JP2012/054450

§ 371 (c)(1),
(2), (4) Date: Aug. 22, 2013

(87) PCT Pub. No.: WO2012/115202

PCT Pub. Date: Aug. 30, 2012

(65) Prior Publication Data

US 2013/0330488 A1 Dec. 12, 2013

(30) Foreign Application Priority Data

Feb. 24, 2011 (JP) ..... 2011-038858

(51) Int. Cl.
*B41M 5/44* (2006.01)
*B41M 5/42* (2006.01)

(52) U.S. Cl.
CPC ..... *B41M 5/443* (2013.01); *B41M 5/42* (2013.01); *B41M 2205/02* (2013.01); *B41M 2205/30* (2013.01); *B41M 2205/36* (2013.01); *B41M 5/44* (2013.01)
USPC ..... 428/32.67; 428/32.64; 428/32.65; 428/32.66; 428/32.68

(58) Field of Classification Search
CPC ..... B41M 5/42; B41M 5/44; B41M 5/443; B41M 2205/02; B41M 2205/30; B41M 2205/36
USPC ..... 428/32.64–32.68; 503/227
See application file for complete search history.

(56) References Cited

FOREIGN PATENT DOCUMENTS

| | | | |
|---|---|---|---|
| JP | 04-018393 | A1 | 1/1992 |
| JP | 06-220401 | A1 | 8/1994 |
| JP | 07-149062 | A1 | 6/1995 |
| JP | 2005-144852 | A1 | 6/2005 |
| JP | 2009-061679 | A1 | 3/2009 |
| JP | 2010-167699 | A1 | 8/2010 |
| JP | 2012-187924 | * | 10/2012 |

OTHER PUBLICATIONS

Japanese Office Action (Application No. 2012-037488) dated Aug. 30, 2013 (with English translation).
International Search Report dated Apr. 24, 2012.

* cited by examiner

*Primary Examiner* — Bruce H Hess
(74) *Attorney, Agent, or Firm* — Burr & Brown, PLLC

(57) ABSTRACT

There is provided a thermal transfer sheet that includes a heat-resistant slipping layer and a colorant layer, the heat-resistant slipping layer and the colorant layer being formable in an in-line process, has excellent heat resistance, and can suppress tailing. The thermal transfer sheet includes a substrate, a colorant layer provided on one surface of the substrate, and a heat-resistant slipping layer provided on the surface of the substrate opposite to the colorant layer, wherein the heat-resistant slipping layer contains at least a binder resin containing an amino group-containing acrylic resin and an epoxysilane, and a slipping agent.

11 Claims, 1 Drawing Sheet

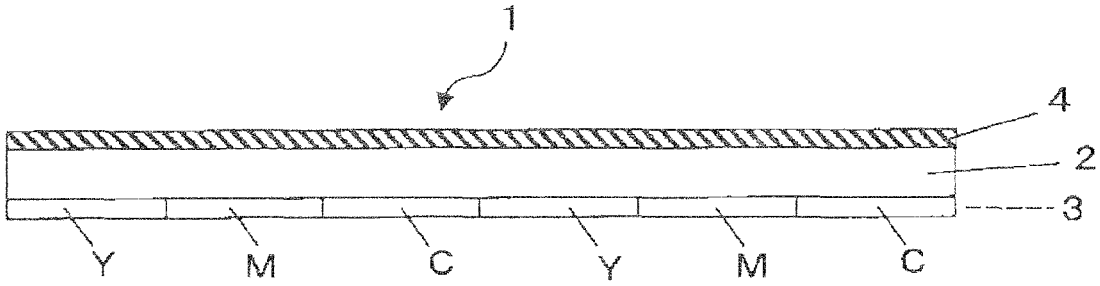
1
4
2
3
Y
M
C
Y
M
C

THERMAL TRANSFER SHEET

TECHNICAL FIELD

The present invention relates to a thermal transfer sheet comprising a substrate, a colorant layer provided on one surface of the substrate, and a heat-resistant slipping layer provided on the other surface of the substrate and more particularly to a thermal transfer sheet that has excellent heat resistance and slipping property and can suppress the occurrence of tailing in printing.

BACKGROUND ART

Various thermal transfer recording methods have hitherto been known. Among them, a method has been proposed in which various full-color images are formed using thermal transfer sheets comprising a colorant layer provided on a substrate, the color layer comprising dyes for dye sublimation transfer supported by a suitable binder. Since the colorants used are dyes, images formed using such thermal transfer sheets are very sharp and highly transparent. Thus, the images have excellent halftone reproducibility and gradation equivalent to those of images obtained by conventional offset printing and gravure printing and have a high quality comparable with that of full-color photographic images.

In the formation of images using thermal transfer sheets, a method is generally adopted that comprises providing a printer provided with a linear thermal head comprising heating elements arranged in a row, scanning, in a direction perpendicular to the longitudinal direction of the thermal head, a thermal transfer sheet and an object that have been superimposed on each other so that the surface of a colorant layer in the thermal transfer sheet faces the object, and, in this state, heating the assembly from the substrate surface side to transfer dyes to the object, thereby forming an image.

In thermal transfer sheets, when printing is carried out by bringing the thermal head into direct contact with the substrate, sticking occurs during scanning by a frictional force applied between the substrate and the thermal head, sometimes leading to defective printing. Further, in some cases, the substrate is fused to the thermal head by heat applied in printing, and this fusing hinders the travel of the thermal transfer sheet, disadvantageously leading to sticking and, in a remarkable case, sometimes leading to sheet breaking. In order to prevent these unfavorable phenomena, in thermal transfer sheets, a heat-resistant slipping layer is provided on the substrate in its surface that comes into contact with the thermal head, that is, the surface of the substrate opposite to the colorant layer, from the viewpoints of improving the heat resistance and imparting a slipping property to realize travel stability.

The heat-resistant slipping layer is formed by coating a coating liquid comprising binder resins and slipping agents, such as phosphoric ester-based surfactants, metal soaps, or talc, as a slipping agent dissolved or dispersed in a suitable solvent on a substrate, and drying the coating. For example, Japanese Patent Application Laid-Open No. 61679/2009 (patent document 1) proposes a thermal transfer sheet that has strength and heat resistance of a heat-resistant slipping layer improved through the combined use of a polyvinyl acetal-based resin and a polyisocyanate as binder resins that cause crosslinking between a hydroxyl group in the polyvinyl acetal and an isocyanate group. Further, Japanese Patent Application Laid-Open No. 144852/2005 (patent document 2) proposes a thermal transfer sheet that has strength and heat resistance of a heat-resistant slipping layer improved through the combined use of an acrylic polyol-based resin and a polyisocyanate as binder resins that cause crosslinking between a hydroxyl group in the acrylic polyol resin and an isocyanate group.

The use of the binder resins from the viewpoint of obtaining a highly heat-resistant slipping layer requires heat for the progress of the crosslinking reaction. Accordingly, a step (an aging step) of, after once forming a heat-resistant slipping layer on a substrate, applying heat to the colorant layer (ink ribbon) is necessary. That is, an off-line step should be adopted. Therefore, an in-line process that can simultaneously form the heat-resistant slipping layer and the colorant layer without passage through the aging step cannot be realized, disadvantageously making it impossible to increase the production speed of thermal transfer sheets.

PRIOR ART DOCUMENT

Patent Document

Patent document 1: Japanese Patent Application Laid-Open No. 61679/2009

Patent document 2: Japanese Patent Application Laid-Open No. 144852/2005

SUMMARY OF THE INVENTION

Problems to be Solved by the Invention

In thermal transfer sheets having a heat-resistant slipping layer that has been formed using the above binder resin and a curing agent, when a process acceleration method such as adoption of an in-line process is carried out, the crosslinking reaction of the binder resin does not satisfactorily proceed and, thus, the heat resistance is unsatisfactory. Therefore, when printing of a high density area requiring high application energy is followed by printing of a low density area, a component in the heat-resistant slipping layer that has been melted due to an influence of energy applied during the printing of the high-density area, is dragged while storing the heat therein, leading to an abnormal color development in printing of the low density area, that is, the so-called "tailing" phenomenon. The tailing is more significant when thermal energy during printing is increased due to an increase in printing speed of a printer.

The present inventors have now found that, when a cured product of a resin composition containing an amino group-containing acrylic resin and an epoxysilane is used as the binder resin component in the heat-resistant active layer, a thermal transfer sheet can be obtained that can realize the formation of the heat-resistant slipping layer and the colorant layer in an in-line process and, at the same time, has excellent heat resistance, and can suppress the occurrence of tailing. The present invention has been made based on such finding.

Accordingly, an object of the present invention is to provide a thermal transfer sheet that can realize the formation of the heat-resistant slipping layer and the colorant layer in an in-line process and, at the same time, has excellent heat resistance, and can suppress the occurrence of tailing.

Means for Solving the Problems

According to the present invention, there is provided a thermal transfer sheet comprising: a substrate; a colorant layer provided on one surface of the substrate; and a heat-resistant slipping layer provided on the surface of the substrate opposite to the colorant layer, wherein the heat-resistant slipping layer contains at least a binder resin containing an amino group-containing acrylic resin and an epoxysilane, and a slipping agent.

In a preferred embodiment of the present invention, the amino group-containing acrylic resin has a glass transition temperature of 30° C. or above.

In a preferred embodiment of the present invention, the proportion of the amine value of the amino group-containing acrylic resin to the epoxy equivalent of the epoxysilane (amine value/epoxy equivalent) is 0.2 to 3.0.

In a preferred embodiment of the present invention, the content of the binder resin in the heat-resistant slipping layer is 30 to 90% by weight on a solid content basis.

In a preferred embodiment of the present invention, the content of the slipping agent in the heat-resistant slipping layer is 5 to 40% by weight on a solid content basis.

Effect of the Invention

In the present invention, a thermal transfer sheet that can realize the formation of the heat-resistant slipping layer and the colorant layer in an in-line process and, at the same time, has excellent heat resistance, and can suppress the occurrence of tailing can be realized by using, as the binder resin component in the heat-resistant slipping layer, a cured product of a resin composition containing an amino group-containing acrylic resin and an epoxysilane.

BRIEF DESCRIPTION OF THE DRAWING

FIG. 1 is a schematic cross-sectional view showing one embodiment of the thermal transfer sheet according to the present invention.

EMBODIMENTS FOR CARRYING OUT THE INVENTION

The thermal transfer sheet according to the present invention comprises a substrate, a colorant layer provided on one surface of the substrate, and a heat-resistant slipping layer provided on the surface of the substrate opposite to the colorant layer. FIG. 1 is a schematic cross-sectional view showing one embodiment of the thermal transfer sheet according to the present invention. The thermal transfer sheet shown in FIG. 1 has a layer construction in which a colorant layer 3 constituted by three layers of a yellow colorant layer (Y), a magenta colorant layer (M), and a cyan colorant layer (C) is provided repeatedly in a face serial manner on one surface of a substrate 2, and a heat-resistant slipping layer 4 is provided on the other surface of the substrate 2.

The layer construction of the thermal transfer sheet according to the present invention is not limited to one shown in FIG. 1. Examples of other construction include a layer construction in which a primer layer (an adhesive layer) that will be described later is provided between the substrate 2 and the heat-resistant slipping layer 4, a layer construction in which a primer layer (an adhesive layer) is provided between the substrate 2 and the colorant layer 3, a layer construction in which, in addition to three types of layers of Y, M, and C, a black colorant layer (Bk) is provided as the layer constituting the colorant layer 3, a layer construction in which Y, M, C, BK, and a protective layer are provided repeatedly in a face serial manner on the substrate in its side where the colorant layer is provided, thereby constituting a protective layer integrated thermal transfer sheet, a layer construction in which a protective layer is provided through a peel layer or a release layer on the substrate in its side where the colorant layer is provided, separately from the colorant layer, whereby, in the thermal transfer sheet having this layer construction, printing of an image can be followed by transfer of a protective layer on the image area, and a layer construction in which an adhesive layer is provided on the protective layer in the thermal transfer sheet from the viewpoint of improving the adhesion between the protective layer and an object (an image-receiving paper). Individual members constituting the thermal transfer sheet will be described.

<Heat-Resistant Slipping Layer>

The thermal transfer sheet according to the present invention comprises a heat-resistant slipping layer provided on one surface of a substrate. The heat-resistant slipping layer can improve the slipping property of the thermal transfer sheet in an non-heated state to realize high-speed printing and, at the same time, can improve resistance to heat conveyed from the thermal head in high-speed printing. In the present invention, the heat-resistant slipping layer contains at least a binder resin and a slipping agent, the binder resin containing an amino group-containing acrylic resin and an epoxysilane.

In the present invention, the resin used as the binder contains an amino group-containing acrylic resin and an epoxysilane as a curing agent for the amino group-containing acrylic resin. When a cured product of a resin composition containing an amino group-containing acrylic resin and an epoxysilane is used as the binder for the heat-resistant slipping layer, a thermal transfer sheet can be realized that can realize the formation of the heat-resistant slipping layer and the colorant layer in an in-line process, has excellent heat resistance, and can suppress the occurrence of tailing. The reason for this has not been elucidated yet but is considered as follows. Specifically, in the thermal transfer sheet produced in an in-line process, a resin containing a polyol-based resin and a polyisocyanate has hitherto been used as the binder for the heat-resistant slipping layer, and the present inventors have found that a hydroxyl group in the binder resin is causative of the occurrence of tailing. Further, as described above, it is considered that, in the resin component containing the amino group-containing acrylic resin and the epoxysilane, the resin can be cured in an in-line process, and, further, the occurrence of tailing can be suppressed because the cured resin is free from a hydroxyl group.

In the present invention, an acrylic resin in which a part of the main chain or the side chain has been modified with an amine is preferably used as the amino group-containing acrylic resin. Preferably, the amine-modified acrylic resin has an acid value of approximately 1.0 to 10.0 mg KOH/g and an amine value of approximately 30 to 50 mg KOH/g. The acid value refers to a theoretical value in terms of the number of milligrams of potassium hydroxide that is equivalent in mole to a carboxyl group per g of the polymer (solid content), and the amine value refers to a theoretical value in terms of the number of milligrams of potassium hydroxide that is equivalent in mole to an amino group per g of the polymer (solid content).

Preferably, the amino group-containing acrylic resin has a glass transition temperature of 30° C. or above, more preferably 50° C. to 100° C. The glass transition temperature refers to a value as measured with a differential scanning calorimeter (DSC) according to JIS K 7121-1987. Commercially available products may be used as such resins, and examples of suitable commercially available products include ACRYDIC series of DIC, that is, A-9521 (acid value=6 mg KOH/g or less, amine value=41 mg KOH/g, Tg=15° C.), A9510 (acid value=6 mg KOH/g or less, amine value=34 mg KOH/g, Tg=30° C.), A-9540 (acid value=7 mg KOH/g or less, amine value=36 mg KOH/g, Tg=50° C.), A-9540-BA (a product that is the same as A-9540, except that only the solvent was changed), BZ-1160 (acid value=4 to 9 mg KOH/g, amine value=47 mg KOH/g, Tg=90° C.), and BZ-1160-BA (a product that is the same as BZ-1160, except that only the solvent was changed).

The epoxysilane used together with the amino group-containing acrylic resin is one that functions as a resin curing agent. Preferably, such curing agents formed of the epoxysilane have an epoxy equivalent of 210 to 720 g/eq in terms of solid content. The epoxy equivalent refers to a theoretical value of the molecular weight of the epoxysilane per functional group (epoxy group). Such epoxysilanes may be commercially available products, and examples of suitable epoxysilanes include ACRYDIC series of DIC, that is, WYY-266 (epoxy equivalent 216 g/eq), A-9585 (epoxy equivalent 448 g/eq), A-9585-BA (a product that is the same as A-9585, except that only the solvent was changed), FZ-521 (epoxy equivalent 354 g/eq), and FZ-523 (epoxy equivalent 710 g/eq).

Preferably, the amino group-containing acrylic resin and the epoxysilane are mixed so that the proportion of the amine value of the amino group-containing acrylic resin to the epoxy equivalent of the epoxysilane (amine value/epoxy equivalent) in the binder resin component is 0.2 to 3.0, more preferably 0.5 to 2.0. When the proportion is in the above-defined range, the "post-printing damage" can be more reliably suppressed, The amino group-containing acrylic resin: the epoxysilane mixing ratio (weight ratio) is preferably 50:50 to 90:10 in terms of solid content.

Further, in the present invention, the content of the binder resin in the heat-resistant slipping layer is preferably, 30 to 90% by weight, more preferably 50 to 90% by weight, in terms of solid content.

The slipping agent contained in the heat-resistant slipping layer is one that functions to improve the slipping property of the heat-resistant slipping layer, particularly to impart a satisfactory slipping property in heating (in printing) by the thermal head. Various publicly known slipping agents may be used as the slipping agent. Metal soaps are preferred as the slipping agent. When the metal soap is contained as the slipping agent, the coefficient of friction between the thermal transfer sheet and the thermal head in printing at an intermediate to high energy level can be reduced. Such metal soaps include, for example, polyvalent metal salts of alkylphosphoric esters and metal salts of alkylcarboxylic acids. Further, in the present invention, among these metal salts, one of or both of zinc stearate and zinc stearyl phosphate is preferred.

In the present invention, the heat-resistant slipping layer may contain a polyethylene wax. The polyethylene wax is one that functions to improve the slipping property of the heat-resistant slipping layer, particularly functions to improve the slipping property of the heat-resistant slipping layer in a non-heated state. Polyethylene wax particles (particles obtained by finely powdering the polyethylene wax) having a density of 0.94 to 0.97 are preferred as the polyethylene wax. High-density or low-density polyethylene waxes are available as the polyethylene wax. Low-density polyethylenes are ethylene polymers that are mainly structurally branched. On the other hand, high-density polyethylenes mainly have a linear structure of polyethylenes.

Polyethylene waxes having a mean particle diameter of 15 μm or less, particularly a mean particle diameter of 7 to 12 μm, are suitable. When the particle diameter is below the lower limit of the above-defined range, the function of imparting the slipping property to the heat-resistant slipping layer is lowered. On the other hand, when the particle diameter is above the upper limit of the above-defined range, waste is likely to be adhered to the thermal head. Polyethylene wax particles may have spherical, angular, columnar, acicular, platy, indefinite or other shapes. In the present invention, however, spherical particles are preferred from the viewpoint of imparting the slipping property to the heat-resistant slipping layer and are advantageous in that an excellent slipping property can be imparted and, at the same time, waste is less likely to be adhered to the thermal head. When the mean particle diameter of the polyethylene wax is in the above-defined range, the high-density polyethylene wax can be protruded on the surface of the heat-resistant slipping layer to impart a proper slipping property to the thermal transfer sheet.

Preferably, the polyethylene wax particles are contained at a ratio of 0.5 to 8% by weight in terms of ratio to the total solid content (100% by weight) of the heat-resistant slipping layer. When the content is below the lower limit of the above-defined range, the slipping property of the heat-resistant slipping layer is lowered. On the other hand, when the content is above the upper limit of the above-defined range, waste is likely to be adhered to the thermal head. Preferably, the polyethylene wax has a melting point of 110 to 140° C. A melting point below the lower limit of the above-defined range is disadvantageous in that the storage stability of the thermal transfer sheet is lowered, or the polyethylene wax per se is melted in the step of drying after coating of the heat-resistant slipping layer, leading to a deterioration in the slipping property of the heat-resistant slipping layer. On the other hand, when the melting point is above the upper limit of the above-defined range, the transfer of the colorant in thermal transfer is likely to be uneven due to surface irregularities of the heat-resistant slipping layer. The melting point may be measured by conventional publicly known methods, for example, a differential scanning calorimeter (DSC).

The slipping agent is contained in the heat-resistant slipping layer from the viewpoint of providing a slipping property in a printing or non-printing state. Inorganic or organic fine particles or silicone oils may be added for an auxiliary regulation of the slipping property. Examples of such inorganic fine particles include clay minerals such as talc and kaolin, carbonates such as calcium carbonate and magnesium carbonate, hydroxides such as aluminum hydroxide and magnesium hydroxide, sulfates such as calcium sulfate, oxides such as silica, graphite, niter, and boron nitride. Examples of such organic fine particles include fine particles of organic resins such as acrylic resins, teflon (registered trademark) resins, silicone resins, lauroyl resins, phenolic resins, acetal resins, polystyrene resins, and nylon resins, or fine particles of crosslinked resins obtained by reacting these resins with a crosslinking agent.

For the inorganic or organic fine particles, the particle diameter is preferably approximately 0.5 to 3 μm in terms of mean particle diameter. The amount of the inorganic or organic fine particles used is preferably 5 to 40 parts by weight based on 100 parts by weight of the binder resin. When the addition amount is below the lower limit of the above-defined range, the slipping property is unsatisfactory. On the other hand, when the addition amount is above the upper limit of the above-defined range, the flexibility and the strength of the formed heat-resistant slipping layer are lowered. The heat-resistant slipping layer may be provided on the substrate sheet by a method that includes dissolving the above ingredients in a proper solvent such as acetone, methyl ethyl ketone, toluene, or xylene to prepare an ink for heat-resistant slipping layer formation, applying the ink on a substrate sheet by commonly used proper printing or coating methods using a gravure coater, a roll coater, a wire bar or the like, heating the wet layer to a temperature of 30° C. to 110° C. to dry the wet layer and, further, reacting the amino group-containing acrylic resin with the epoxysilane to form a heat-resistant slipping layer.

The heat-resistant slipping layer has a thickness of 0.05 to 5 μm, preferably 0.1 to 1 μm. When the thickness of the heat-resistant slipping layer is less than 0.05 μm, the effect attained as the heat-resistant slipping layer is unsatisfactory. On the other hand, when the thickness of the heat-resistant slipping layer is more than 1 μm, thermal transfer from the thermal head to the thermally transferable colorant layer is deteriorated, disadvantageously resulting in lowered print density. When the heat-resistant slipping layer is provided on the substrate sheet in an in-line process, preferably, the provision of the heat-resistant slipping layer on the substrate sheet is followed by the provision of the colorant layer from the viewpoint of avoiding an influence of heat on the colorant layer.

<Substrate>

The thermal transfer sheet according to the present invention comprises the heat-resistant slipping layer provided on a substrate. The substrate may be any conventional publicly known substrate so far as it has a certain level of heat resistance and strength. Examples thereof include resin films such as polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellophane, cellulose derivatives such as cellulose acetate, polyethylene films, polyvinyl chloride films, nylon films, polyimide films, and ionomer films.

The thickness of the substrate is generally about 0.5 to 50 μm, preferably about 1.5 to 10 μm. The substrate may be subjected to surface treatment from the viewpoint of improving adhesion to an adjacent layer. Publicly known resin surface modification techniques such as corona discharge treatment, flame treatment, ozone treatment, ultraviolet treatment, radiation treatment, roughening treatment, chemical agent treatment, plasma treatment, and grafting treatment may be applied as the surface treatment. One of or a combination of two or more of these techniques may be carried out as the surface treatment.

In the present invention, among the above surface treatment methods, corona treatment or plasma treatment is preferred from the viewpoint of low cost. If necessary, an undercoating layer (a primer layer) may also be provided on one surface or both surfaces thereof. The primer treatment may be carried out, for example, by coating, in melt extrusion of a plastic film to form a film, a primer liquid onto an unstretched film and then subjecting the assembly to stretching treatment. Alternatively, the primer layer (adhesive layer) may be formed by coating between the substrate and the heat-resistant slipping layer. The primer layer may be formed of, for example, polyester-based resins, polyacrylic ester-based resins, polyvinyl acetate-based resins, polyurethane-based resins, styrene acrylate-based resins, polyacrylamide-based resins, polyamide-based resins, polyether-based resins, polystyrene-based resins, polyethylene-based resins, polypropylene-based resins, vinyl-based resins such as polyvinyl chloride resins, polyvinyl alcohol resins and polyvinylidene chloride resins, and polyvinyl acetal-based resins such as polyvinylacetoacetal and polyvinylbutyral, and cellulosic resins.

<Colorant Layer>

The thermal transfer sheet according to the present invention comprises a colorant layer on the substrate in its surface opposite to the heat-resistant slipping layer. In the thermal transfer sheet according to the present invention, when a monochrome image is desired, only a one-color layer that has been properly selected as the colorant layer may be formed. When a full-color image is desired, cyan, magenta, and yellow (and further optionally black) may be selected for colorant layer formation.

When the thermal transfer sheet according to the present invention is a dye-sublimation thermal transfer sheet, sublimable dye-containing layers are formed as the colorant layer. On the other hand, when the thermal transfer sheet according to the present invention is a heat-fusion thermal transfer sheet, heat-fusion ink layers colored with pigments or the like are formed as the colorant layer. The thermal transfer sheet according to the present invention will be described by taking a dye-sublimation thermal transfer sheet as an example. However, it should be noted that the thermal transfer sheet according to the present invention is not limited to the dye-sublimation thermal transfer sheet only and may be of a heat-fusion type.

Sublimable dyes usable for subimable dye layers are not particularly limited and may be conventional publicly known ones. Examples of such sublimable dyes include diarylmethane dyes; triarylmethane dyes; thiazole dyes; merocyanine dyes; pyrazolone dyes; methine dyes; indoaniline dyes; azomethine dyes such as acetophenoneazomethine dyes, pyrazoloazomethine dyes, imidazoleazomethine dyes, imidazoazomethine dyes, and pyridoneazomethine dyes; xanthene dyes; oxazine dyes; cyanostyrene dyes such as dicyanostyrene dyes and tricyanostyrene dyes; thiazine dyes; azine dyes; acridine dyes; benzeneazo dyes; azo dyes such as, pyridoneazo dyes, thiopheneazo dyes, isothiazoleazo dyes, pyrroleazo dyes, pyrazoleazo dyes, imidazoleazo dyes, thiadiazoleazo dyes, triazoleazo dyes, and disazo dyes; spiropyran dyes; indolinospiropyran dyes; fluoran dyes; rhodaminelactam dyes; naphthoquinone dyes; anthraquinone dyes; and quinophthalone dyes. Specific examples of additional dyes include compounds exemplified in Japanese Patent Application Laid-Open No. 149062/1995.

In the dye layers, 5 to 90% by weight, preferably 20 to 80% by weight, based on the total solid content, of the dye layers is accounted for by sublimable dyes. The amount of the sublimable dyes used is below the lower limit of the above-defined range, the print density is sometimes lowered. On the other hand, when the amount of the sublimable dyes used is above the upper limit of the above-defined range, for example, the storage stability is sometimes lowered.

Resins that have heat resistance and a suitable level of affinity for dyes are generally usable as binder resins for supporting the dyes. Examples of such binder resins include: cellulosic resins such as ethylcellulose, hydroxyethylcellulose, ethylhydroxycellulose, hydroxypropylcellulose, methylcellulose, cellulose acetate, and cellulose butyrate; vinyl-based resins such as polyvinyl alcohol, polyvinyl acetate, polyvinyl butyral, polyvinyl acetoacetal, and polyvinylpyrrolidone; acryl-based resins such as poly(meth)acrylates and poly(meth)acrylamides; polyurethane-based resins; polyamide-based resins; and polyester-based resins. Among them, cellulosic resins, vinyl-based resins, acryl-based resins, urethane-based resins, polyester-based resins and the like are preferred from the viewpoints of excellent properties such as excellent heat resistance and dye transferability. Vinyl-based resins are more preferred. Polyvinylbutyral, polyvinylacetoacetal and the like are particularly preferred.

If desired, additives such as release agents, inorganic fine particles, and organic fine particles may be used in the dye layers. Examples of such release agents include silicone oils and phosphoric esters. Examples of such inorganic fine particles include carbon black, aluminum, and molybdenum disulfide. Examples of such organic fine particles include polyethylene waxes.

The dye layer may be formed by dissolving or dispersing the dye and the binder resin together with optional additives in a suitable organic solvent or water to prepare a coating liquid, coating the coating liquid on one surface of the substrate by a conventional method such as gravure printing, screen printing, and reverse roll coating printing using a gravure plate, and drying the coating.

Examples of organic solvents usable herein include toluene, methyl ethyl ketone, ethanol, isopropyl alcohol, cyclohexanone, and dimethylformamide (DMF). The coverage of the dye layer is approximately 0.2 to 6.0 g/m$^2$, preferably approximately 0.2 to 3.0 g/m$^2$, on a dry solid content basis.

<Other Layers>

As long as the thermal transfer sheet according to the present invention comprises a substrate, a colorant layer provided on one surface of the substrate, and a heat-resistant slipping layer provided on the other surface of the substrate, other layers such as an adhesive layer, a peel layer, a release layer, or an undercoating layer may be provided as a transfer protective protective layer. When the transfer protective layer is provided in a face serial relationship with the colorant layer, after image formation, a protective layer that protects the surface of the image can be transferred.

The construction and preparation of the transfer protective layer are not particularly limited and may be selected from conventional publicly known techniques depending upon characteristics of the substrate sheet, the colorant layer and the like used. The undercoating layer is not particularly limited, and a composition that improves the adhesion between the substrate and the colorant layer and the transfer efficiency of the dye may be properly selected for undercoating layer formation.

<Method for Image Formation Using Thermal Transfer Sheet>

Printing can be carried out using the thermal transfer sheet according to the present invention by heating and pressing a portion corresponding to a printing area in the thermal transfer sheet from the heat-resistant slipping layer side of the substrate by a thermal head or the like to transfer the colorant to an object. The printer used in the thermal transfer is not particularly limited, and publicly known thermal transfer printers may be used.

When the thermal transfer sheet according to the present invention is a dye sublimation thermal transfer sheet, for example, a thermal transfer image-receiving sheet may be used as the object. The thermal transfer image-receiving sheet comprises a dye-receptive layer provided on one surface of a substrate. Individual layers constituting the thermal transfer image-receiving sheet will be described.

The substrate layer constituting the thermal transfer image-receiving sheet has a function of holding the receptive layer and preferably has a mechanical strength high enough to pose no problem in handling even in a heated state because heat is applied in thermal transfer. Any material may be used as the material for the substrate layer without particular limitation, and examples thereof include capacitor papers, glassine papers, parchment papers, synthetic papers (for example, polyolefin-based or polystyrene-based papers), wood free papers, art papers, coated papers, cast coated papers, wall papers, backing papers, synthetic resin- or emulsion-impregnated papers, synthetic rubber latex impregnated papers, synthetic resin internally added papers, board papers, or cellulose fiber papers, resin coated papers that are cellulose papers having obverse and reverse surfaces coated with polyethylene and are used as a substrate of photographic papers for silver salt photographs, or films or sheets formed of various plastics such as polyesters, polyacrylates, polycarbonates, polyurethanes, polyimides, polyetherimides, cellulose derivatives, polyethylenes, ethylene-vinyl acetate copolymers, polypropylenes, polystyrenes, acrylic resins, polyvinyl chloride, and polyvinylidene chlorides. Films having microvoids in the inside of a substrate (porous films) obtained by adding a white pigment or a filler to these synthetic resins and forming films from the mixture may also be used.

Further, a laminate comprising any combination of the above materials may also be used as the substrate layer. Typical examples of such laminates include synthetic papers such as a laminate of a cellulose fiber paper and a synthetic paper and a laminate of a cellulose fiber paper and a plastic film or sheet. The laminated synthetic paper may have a two-layer structure, or alternatively may have a laminate of three or more layers comprising a cellulose fiber paper (used as a core) and a synthetic paper, a plastic film or a porous film applied to both surfaces of the cellulose fiber paper from the viewpoint of imparting handle or texture to the substrate. Further, the laminate may be one obtained by providing an empty particle-dispersed resin layer by coating on a surface of a coated paper, a resin coated paper, a plastic film or the like to impart heat insulating properties.

Dry lamination, wet lamination, extrusion and the like may be used without limitation as application methods in the laminates. Methods for stacking the empty-particle layer include, but are not limited to, coating means such as gravure coating, comma coating, blade coating, die coating, slide coating, and curtain coating.

The thickness of the applied substrate or the laminated substrate may be any one and is generally approximately 10 to 300 μm. When the base has a poor adhesion to layers formed on the surface thereof, preferably, the surface may be subjected to various primer treatment or corona discharge treatment. When the empty-particle layer is provided, from the viewpoints of adhesion and manufacture efficiency, preferably, the empty-particle layer and the receptive layer or other layer are simultaneously multilayer-coated by slide coating or curtain coating.

The dye-receptive layer provided on the substrate layer functions to receive a sublimable dye being transferred from the thermal transfer sheet and to hold the formed image. Resins for receptive layer formation include polycarbonate-based resins, polyester-based resins, polyamide-based resins, acryl-based resins, acryl-styrene-based resins, cellulosic resins, polysulfone-based resins, polyvinyl chloride-based resins, vinyl chloride-acryl-based resins, polyvinyl acetate-based resins, vinyl chloride-vinyl acetate copolymer resins, polyvinyl acetal resins, polyvinyl butyral resins, polyurethane resins, polystyrene resins, polypropylene resins, polyethylene resins, ethylene-vinyl acetate copolymer resins, epoxy resins, polyvinyl alcohol resins, gelatin, and derivatives thereof. These resin materials may also be used as a mixture of two or more of them.

The dye-receptive layer may be formed by coating a solvent-type coating liquid, prepared by dissolving or dispersing the resin in a proper solvent, on a surface of a substrate layer to form a coating, and drying the coating. In addition to the dye-receptive layer using the solvent-type coating liquid, that is, the so-called solvent-type dye-receptive layer, a dye-receptive layer using an aqueous coating liquid prepared by dissolving the resin in an aqueous solvent, that is, the so-called aqueous dye-receptive layer, is possible. The solvent-type thermal transfer image-receiving sheet is superior in releaseability from the thermal transfer sheet to the aqueous thermal transfer image-receiving sheet. On the other hand, images formed in the aqueous thermal transfer image-receiving sheet have a higher gloss than images formed in the solvent-type thermal transfer image-receiving sheet, and, thus, thermal transfer image-receiving sheets including an aqueous receptive layer are likely to be preferred in applications where a high gloss is required of images to be formed. Further, in recent years, there is an increasing tendency towards the use of aqueous thermal transfer image-receiving sheet, for example, in consideration of a problem of treatment of waste liquids on environments.

Water-soluble resins or aqueous resins may be mentioned as resins dissolvable or dispersible in aqueous solvents. Water-soluble resins include polyvinyl pyrrolidones, polyvinyl alcohols, hydroxyethylcelluloses, carboxymethylcelluloses, phenolic resins, water-soluble acrylic resins such as polyacrylic acids, polyacrylic esters, polyacrylic ester copolymers, and polymethacrylic acids, gelatin, starch, casein, and modification products thereof. Aqueous resins include vinyl chloride-based resin emulsions such as vinyl chloride resin emulsions, vinyl chloride-vinyl acetate resin emulsions, and vinyl chloride-acrylic resin emulsions, acryl-based resin emulsions, urethane-based resin emulsions, vinyl chloride-based resin dispersions, acryl-based resin dispersions, and urethane-based resin dispersions. These aqueous resins may be prepared, for example, by dispersing a solution containing a solvent-type resin with a homogenizer.

The thermal transfer image-receiving sheet may contain a release agent in the dye-receptive layer from the viewpoint of improving releasability from the thermal transfer sheet. Release agents include solid waxes such as polyethylene waxes, amide waxes and teflon (registered trademark) powders, fluorine-based or phosphoric ester-based surfactants, silicone oils, reactive silicone oils, curable silicone oils or other various modified silicone oils, and various silicone resins. Among them, silicone oils are preferred. The silicone oils may be oily but are preferably curable. Curable silicone oils include reaction curable, photocurable, and catalyst curable silicone oils. Reaction curable and catalyst curable silicone oils are particularly preferred.

The addition amount of these curable silicone oils is preferably 0.5 to 30% by weight of the resin constituting the dye-receptive layer. The release agent layer may also be provided by dissolving or dispersing the release agent in a suitable solvent, coating the solution or dispersion on part of the surface of the receptive layer, and drying the coating. The thickness of the release agent layer is preferably 0.01 to 5.0 μm, particularly preferably 0.05 to 2.0 μm. When the dye-receptive layer is formed using a coating liquid with a silicone oil added thereto, the release agent layer may be formed by curing the silicone oil that has bled out on the surface after coating. In the formation of the dye-receptive layer, pigments or fillers such as titanium oxide, zinc oxide, kaolin, clay, calcium carbonate, and finely divided silica may be added from the viewpoint of improving the whiteness of the dye-receptive layer to further enhance the sharpness of the transferred image. Plasticizers such as phthalic ester compounds, sebacic ester compounds, and phosphoric ester compounds may also be added.

The dye-receptive layer is formed by coating the solvent-type coating liquid or the aqueous coating liquid on the substrate layer, for example, by wire bar coating, gravure coating, slide coating, or roll coating and drying the coating. The thickness of the dye-receptive layer is not particularly limited but is generally 0.5 to 10 μm.

When the dye-receptive layer is formed using the aqueous coating liquid, there is a possibility that, when the coating liquid is coated on the surface of a coated paper as the substrate layer, the coated paper absorbs water, leading to curling in the thermal transfer image-receiving sheet. To overcome this drawback, when the aqueous coating liquid is coated on a water-absorptive substrate layer, preferably, a sealing layer is provided between the substrate layer and the dye-receptive layer. As described below, preferably, other layers are provided between the substrate layer and the dye-receptive layer. The thickness of the sealing layer is not particularly limited and is approximately 0.2 g/m$^2$ to 10.0 g/m$^2$.

Any of conventional publicly known intermediate layer may be provided between the substrate layer and the dye-receptive layer from the viewpoint of imparting the adhesion between the dye-receptive layer and the substrate, whiteness, cushioning properties, concealing properties, antistatic properties, curling preventive properties and other properties. Binder resins usable in the intermediate layer include polyurethane-based resins, polyester-based resins, polycarbonate-based resins, polyamide-based resins, acryl-based resins, polystyrene-based resins, polysulfone-based resins, polyvinyl chloride resins, polyvinyl acetate resins, vinyl chloride-vinyl acetate copolymer resins, polyvinyl acetal resins, polyvinyl butyral resins, polyvinyl alcohol resins, epoxy resins, cellulose-based resins, ethylene-vinyl acetate copolymer resins, polyethylene-based resins, and polypropylene-based resins. For resins containing an active hydroxyl group among these resins, isocyanate cured products thereof may be used as the binder.

Preferably, fillers such as titanium oxide, zinc oxide, magnesium carbonate, and calcium carbonate are added to the intermediate layer from the viewpoint of imparting whiteness and concealing properties. Further, stilbene-based compounds, benzimidazolestilbene-based compound compounds, benzoxazole-based compounds and the like may be added as optical brightening agent from the viewpoint of enhancing the whiteness; hindered amine-based compounds, hindered phenol-based compounds, benzotriazole-based compounds, benzophenone-based compounds and the like may be added as ultraviolet absorbers or antioxidants from the viewpoint of enhancing lightfastness of printed matters; or cationic acrylic resins, polyaniline reins, various conductive fillers and the like may be added from the viewpoint of imparting antistatic properties. The coverage of the intermediate layer is preferably approximately 0.5 to 30 g/m$^2$ on a dry basis.

The resin binder contained in the empty layer is preferably an emulsion comprising a water-insoluble hydrophobic polymer dispersed as fine particles in a water-soluble dispersion medium, or a hydrophilic binder. Such emulsions usable herein include acryl-based emulsions, polyester-based emulsions, polyurethane-based emulsions, SBR-based (styrene-butadiene rubber) emulsions, polyvinyl chloride-based emulsions, polyvinyl acetate-based emulsions, polyvinylidene chloride-based emulsions, and polyolefine-based emulsions. If necessary, a mixture of two or more of them may also be used. Hydrophilic binders include gelatin and derivatives thereof, polyvinyl alcohols, polyethylene oxide, polyvinyl pyrrolidone, pullulan, carboxymethylcellulose, hydroxyethylcellulose, dextran, dextrin, polyacrylic acid and salts thereof, agar, κ-carageenan, λ-carageenan, ι-carageenan, casein, xanthan gum, locust bean gum, alginic acid, and gum arabic. Gelatin is particularly preferred. The use of such hydrophilic binders can contribute to an improvement in interlayer adhesion between the dye-receptive layer and layers in contact with the dye-receptive layer. In particular, when the layers are formed by aqueous coating and simultaneous multilayer coating methods, the use of gelatin as the binder resin can realize the regulation of each coating liquid in a desired viscosity range that in turn can form a layer having a desired thickness. In the present invention, commercially available gelatin may also be used, and examples of preferred commercially available gelatins include RR, R, and CLV (manufactured by Nitta Gelatin Inc.).

EXAMPLES

The present invention is further illustrated by the following Examples that are not intended as a limitation of the invention. "Parts" or "%" are by weight unless otherwise specified.

Example 1

A coating liquid 1 having the following composition for a heat-resistant slipping layer was coated on one surface of a 4.5 μm-thick substrate sheet formed of an easy-adhesion treated polyethylene terephthalate film at a coverage of 0.5 g/m$^2$ on a solid content basis, and the coating was dried to form a heat-resistant slipping layer.

| <Coating liquid 1 for heat-resistant slipping layer> | |
|---|---|
| Amine-modified silicone acrylic resin (BZ1160, manufactured by DIC) | 56.1 parts |
| Epoxysilane (A9585, manufactured by DIC) | 23.9 parts |
| zinc stearylphosphate (LBT-183 (purified product), manufactured by Sakai Chemical Co., Ltd.) | 10.0 parts |
| Zinc stearate (SZ-PF, manufactured by Sakai Chemical Co., Ltd.) | 5.0 parts |
| Filler (Microace P-3, manufactured by Nippon Talc Co., Ltd.) | 5.0 parts |
| Methyl ethyl ketone | 450.0 parts |
| Toluene | 450.0 parts |

A coating liquid having the following composition for a primer layer was coated on a part of the surface of the substrate sheet opposite to the heat-resistant slipping layer at a coverage of 0.10 g/m$^2$ on a dry basis, and the coating was dried to form a primer layer.

| <Coating liquid for primer layer> | |
|---|---|
| Colloidal silica (particle diameter: 4 to 6 nm, solid content: 10%) (Snowtex OXS, manufactured by Nissan Chemical Industries Ltd.) | 30 parts |
| Polyvinyl pyrrolidone resin (K-90, manufactured by ISP) | 3 parts |
| Water | 50 parts |
| Isopropyl alcohol | 17 parts |

Subsequently, a coating liquid (Y) having the following composition for a yellow dye layer, a coating liquid (M) having the following composition for a magenta dye layer, and a coating liquid (C) having the following composition for a cyan dye layer were coated on the primer layer at a coverage of 0.6 g/m$^2$ on a dry basis for each layer, followed by drying. This procedure was repeated to form the yellow, magenta, and cyan dye layers in that order in a face serial manner.

| <Coating liquid (Y) for a yellow dye layer> | |
|---|---|
| Disperse dye (Disperse Yellow 231) | 2.5 parts |
| Disperse dye (yellow dye A represented by the following chemical formula) | 2.5 parts |
| Binder resin (polyvinyl acetoacetal resin KS-5, manufactured by Sekisui Chemical Co., Ltd.) | 4.5 parts |
| Phosphoric ester-based surfactant (Plysurf A208N, manufactured by Dai-Ichi Kogyo Seiyaku) | 0.1 part |
| Polyethylene wax | 0.1 part |
| Methyl ethyl ketone | 45.0 parts |
| Toluene | 45.0 parts |

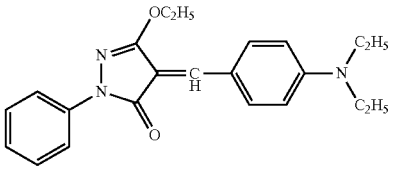

| <Coating liquid (M) for magenta dye layer> | |
|---|---|
| Disperse dye (MS Red G) | 1.5 parts |
| Disperse dye (Macrolex Red Violet R) | 2.0 parts |
| Binder resin (polyvinyl acetoacetal resin KS-5, manufactured by Sekisui Chemical Co., Ltd.) | 4.5 parts |
| Phosphoric ester-based surfactant (Plysurf A208N, manufactured by Dai-Ichi Kogyo Seiyaku) | 0.1 part |
| Polyethylene wax | 0.1 part |
| Methyl ethyl ketone | 45.0 parts |
| Toluene | 45.0 parts |

| <Coating liquid (C) for cyan dye layer> | |
|---|---|
| Disperse dye (Solvent Blue 63) | 2.5 parts |
| Disperse dye (Disperse Blue 354) | 2.5 parts |
| Binder resin (polyvinyl acetoacetal resin KS-5, manufactured by Sekisui Chemical Co., Ltd.) | 4.5 parts |
| Phosphoric ester-based surfactant (Plysurf A208N, manufactured by Dai-Ichi Kogyo Seiyaku) | 0.1 part |
| Polyethylene wax | 0.1 part |
| Methyl ethyl ketone | 45.0 parts |
| Toluene | 45.0 parts |

Thus, a thermal transfer sheet was obtained that included a heat-resistant slipping layer provided on one surface of a substrate layer, and primer layer/dye layer (Y, M, C) stacked on the surface of the substrate layer opposite to the heat-resistant slipping layer.

Examples 2 to 11 and Comparative Examples 1 to 4

Thermal transfer sheets of Examples 2 to 11 and Comparative Examples 1 to 4 were prepared in the same manner as in Example 1, except that the heat-resistant slipping layer was formed using coating liquids 2 to 15 for a heat-resistant slipping layer that have respective compositions shown in Tables 1 and 2 below instead of the coating liquid 1 for a heat-resistant slipping layer.

TABLE 1

| Component | | | Coating liquid for heat-resistant slipping layer | | | | | | | |
|---|---|---|---|---|---|---|---|---|---|---|
| | | | 1 | 2 | 3 | 4 | 5 | 6 | 7 | 8 |
| Binder | Main agent | BZ1160 | 56.1 | 56.1 | — | — | — | 66.3 | 47.7 | 43.2 |
| | | A-9540 | — | — | 59.8 | — | — | — | — | — |
| | | A-9510 | — | — | — | 60.6 | — | — | — | — |
| | | A-9521 | — | — | — | — | 59.8 | — | — | — |
| | | BR-73 | — | — | — | — | — | — | — | — |
| | | #3000-1 | — | — | — | — | — | — | — | — |
| | | BX-1 | — | — | — | — | — | — | — | — |
| | Curing agent | A9585 | 23.9 | 23.9 | 20.2 | 19.4 | 20.2 | — | — | 36.8 |
| | | WYY-266 | — | — | — | — | — | 13.7 | — | — |
| | | FZ-523 | — | — | — | — | — | — | 32.3 | — |
| | | D-750 | — | — | — | — | — | — | — | — |
| Slipping agent | SZ-PF | | 5.0 | — | 5.0 | 5.0 | 5.0 | 5.0 | 5.0 | 5.0 |
| | LBT-1830 (purified) | | 10.0 | — | 10.0 | 10.0 | 10.0 | 10.0 | 10.0 | 10.0 |
| | A208N | | — | 15.0 | — | — | — | — | — | — |
| | Talc P3 | | 5.0 | 5.0 | 5.0 | 5.0 | 5.0 | 5.0 | 5.0 | 5.0 |
| Solvent | Methyl ethyl ketone | | 450.0 | 450.0 | 450.0 | 450.0 | 450.0 | 450.0 | 750 | 720 |
| | Toluene | | 450.0 | 450.0 | 450.0 | 450.0 | 450.0 | 450.0 | 150 | 180 |
| Total | | | 1000 | 1000 | 1000 | 1000 | 1000 | 1000 | 1000 | 1000 |

TABLE 2

| Component | | | Coating liquid for heat-resistant slipping layer | | | | | | |
|---|---|---|---|---|---|---|---|---|---|
| | | | 9 | 10 | 11 | 12 | 13 | 14 | 15 |
| Binder | Main agent | BZ1160 | 65.9 | 47 | 76.4 | — | — | — | — |
| | | A-9540 | — | — | — | — | — | — | — |
| | | A-9510 | — | — | — | — | — | — | — |
| | | A-9521 | — | — | — | — | — | — | — |
| | | BR-73 | — | — | — | 56.1 | 80 | — | — |
| | | #3000-1 | — | — | — | — | — | 37.5 | — |
| | | BX-1 | — | — | — | — | — | — | 40.9 |
| | Curing agent | A9585 | 14.1 | 33 | 3.6 | 23.9 | — | — | — |
| | | WYY-266 | — | — | — | — | — | — | — |
| | | FZ-523 | — | — | — | — | — | — | — |
| | | D-750 | — | — | — | — | — | 42.5 | 39.1 |
| Slipping agent | SZ-PF | | 5.0 | 5.0 | 5.0 | 5.0 | 5.0 | 5.0 | 5.0 |
| | LBT-1830 (purified) | | 10.0 | 10.0 | 10.0 | 10.0 | 10.0 | 10.0 | 10.0 |
| | A208N | | — | — | — | — | — | — | — |
| | Talc P3 | | 5.0 | 5.0 | 5.0 | 5.0 | 5.0 | 5.0 | 5.0 |
| Solvent | Methyl ethyl ketone | | 450.0 | 450.0 | 450.0 | 450.0 | 450.0 | 450.0 | 750 |
| | Toluene | | 450.0 | 450.0 | 450.0 | 450.0 | 450.0 | 450.0 | 150 |
| Total | | | 1000 | 1000 | 1000 | 1000 | 1000 | 1000 | 1000 |

In the tables, BR-73 represents Dianal BR-73 manufactured by Mitsubishi Rayon Co., Ltd., #3000-1 represents Denka Butyral #3000-1 that is a polyvinylbutyral resin manufactured by Denki Kagaku Kogyo K.K., BX-1 represents S-lec BX-1 that is a polyvinylbutyral resin manufactured by Sekisui Chemical Co., Ltd., and D750 represents Burnock D750-45 that is a polyisocyanate (solid content: 100% by weight, NCO=17.3% by weight) manufactured by Dainippon Ink and Chemicals, Inc.

Further, in the tables, SZ-PF is zinc stearate manufactured by Sakai Chemical Co., Ltd., LBT-1830 (purified) represents zinc stearylphosphate manufactured by Sakai Chemical Co., Ltd., A208N represents Plysurf A208A manufactured by Dai-Ichi Kogyo Seiyaku Co., Ltd., and Talc P3 represents talc manufactured by Nippon Talc Co., Ltd.

Print Evaluation 1 (Tailing)

Thermal transfer sheets thus obtained were stored under an environment of 40° C. and 90% RH for 24 hr, were then allowed to stand at room temperature for one hr, were then applied to yellow, magenta, and cyan areas in a genuine ribbon for a printer CW-01 manufactured by CITIZEN SYSTEMS JAPAN CO., LTD., and were used in combination with a genuine thermal transfer image-receiving sheet of a postal card size for CW-01, manufactured by CITIZEN SYSTEMS JAPAN CO., LTD. Under an environment of 15° C. and 20% RH, a pattern of a maximum print gradation value (a high gradation area) was printed in an upper half area, and a print pattern of 80/255 gradation (a gray area) was printed in a lower half area. Visual inspection was made for the presence of an area where the density was higher than the other areas, that is, tailing, at the gray area printed immediately after the printing of the high gradation area, and the results were evaluated according to the following criteria.

1: Tailing occurred in a length of a half or more of the length of the gray area printed immediately after the high gradation area printing.

2: Tailing occurred in a length of a half to one-fourth of the length of the gray area printed immediately after the high gradation area printing.

3: Tailing occurred in a length of one-fourth or less of the length of the gray area printed immediately after the high gradation area printing.

4: No tailing occurred.

The results of evaluation were as shown in Table 3 below.

Print Evaluation 2 (Post Printing Damage)

The thermal transfer sheets thus obtained were stored for 24 hr under an environment of 40° C. and 90% RH, were then allowed to stand at room temperature for one hr, were applied to yellow, magenta, and cyan areas in a genuine ribbon for a printer CW-01 manufactured by CITIZEN SYSTEMS JAPAN CO., LTD., and were used in combination with a genuine thermal transfer image-receiving sheet of a postal card size for CW-01, manufactured by CITIZEN SYSTEMS JAPAN CO., LTD. Under an environment of 15° C. and 20% RH, a black blotted image print pattern was printed in an upper half area. Visual inspection was made for the presence of a portion that had undergone a change in color due to damage to the heat-resistant slipping layer during printing by the printed matter and the "black blotted image" area in the ribbon after use in the printing, that is, for the occurrence of "post-printing damage," and the results were evaluated according to the following criteria.

1: "Post-printing damage" occurred in the whole area of the "black blotted image."

2: "Post-printing damage" occurred in an area of approximately half of the "black blotted image."

3: "Post-printing damage" occurred slightly at both ends of the "black blotted image."

4: No "post-printing damage" occurred.

The results of evaluation were as shown in Table 3 below.

Evaluation of Slipping Property (Friction of Back Surface)

The thermal transfer sheets obtained above were used in combination with a thermal transfer image-receiving sheet for a dye sublimation printer (CP9000D) manufactured by Mitsubishi Electric Corporation to measure frictional force in printing under the following conditions. Printing and the measurement of the frictional force were carried out with a thermal transfer printer with a frictional force measurement function described in Japanese Patent Application Laid-Open No. 300338/2003.

<Conditions for Printing>

Thermal head: Thermal head manufactured by Toshiba Hokuto Electronics Corporation; head resistance value 5020Ω; resolution 300 dpi (dots per inch)

Line speed: 1 ms/line (resolution in sheet convey direction: 300 lpi (lines per inch))

Pulse duty: 90%

Applied voltage: 30.0 V

Printing pressure: 40 N

Printed image: 1388 pixels in width×945 pixels in length; gradation image of gradations 0 to 255 (1 pixel corresponds to 1 dot).

A blotted image pattern of a highest print gradation value (high density area) and a blotted image pattern of gradation value of 128/255 (grey) (medium density area) were printed under the above conditions. The coefficient of dynamic friction was measured at that time, and the heat resistance was evaluated according to the following criteria.

1: A coefficient of dynamic friction of not less than 0.5

2: A coefficient of dynamic friction of 0.4 (inclusive) to 0.5 (exclusive)

3: A coefficient of dynamic friction of less than 0.4.

The results of evaluation were as shown in Table 3 below.

TABLE 3

| | Thermal transfer sheet | | | | | | | Evaluation | | |
|---|---|---|---|---|---|---|---|---|---|---|
| | | Main agent | | Curing agent | Amine | Main agent:curing | | | | |
| | Heat-resistant slipping layer | Tg (° C.) | Amine value (mg KOH/g) | Epoxy value (g/eq) | value/epoxy equivalent ratio | agent mass ratio | Tailing | Post-printing damage | Frinction of back surface |
| Example 1 | (Coating liquid 1 for heat-resistant slipping layer) | 80 | 47 | 448 | 1.0 | 70:30 | 4 | 4 | 3 |
| Example 2 | (Coating liquid 2 for heat-resistant slipping layer) | 80 | 47 | 448 | 1.0 | 70:30 | 3 | 4 | 3 |
| Example 3 | (Coating liquid 3 for heat-resistant slipping layer) | 50 | 36 | 448 | 1.0 | 75:25 | 4 | 4 | 3 |
| Example 4 | (Coating liquid 4 for heat-resistant slipping layer) | 30 | 34 | 448 | 1.0 | 76:24 | 4 | 4 | 3 |
| Example 5 | (Coating liquid 5 for heat-resistant slipping layer) | 15 | 41 | 448 | 1.0 | 73:27 | 4 | 2 | 3 |
| Example 6 | (Coating liquid 6 for heat-resistant slipping layer) | 80 | 47 | 216 | 1.0 | 83:17 | 4 | 4 | 3 |
| Example 7 | (Coating liquid 7 for heat-resistant slipping layer) | 80 | 47 | 710 | 1.0 | 60:40 | 4 | 4 | 3 |
| Example 8 | (Coating liquid 8 for heat-resistant slipping layer) | 80 | 47 | 448 | 2.0 | 54:46 | 4 | 4 | 3 |
| Example 9 | (Coating liquid 9 for heat-resistant slipping layer) | 80 | 47 | 448 | 0.5 | 82:18 | 4 | 4 | 3 |
| Example 10 | (Coating liquid 10 for heat-resistant slipping layer) | 80 | 47 | 448 | 3.0 | 40:60 | 3 | 2 | 3 |
| Example 11 | (Coating liquid 11 for heat-resistant slipping layer) | 80 | 47 | 448 | 0.2 | 5:95 | 3 | 2 | 3 |
| Comparative Example 1 | (Coating liquid 12 for heat-resistant slipping layer) | 100 | — | 448 | — | — | 1 | 2 | 3 |
| Comparative Example 2 | (Coating liquid 13 for heat-resistant slipping layer) | 100 | — | — | — | — | 1 | 2 | 3 |
| Comparative Example 3 | (Coating liquid 14 for heat-resistant slipping layer) | 68 | — | — | — | — | 1 | 4 | 3 |
| Comparative Example 4 | (Coating liquid 15 for heat-resistant slipping layer) | 90 | — | — | — | — | 1 | 4 | 3 |

Examples 12 to 14

Preparation of Thermal Transfer Image-Receiving Sheet

The following three types of thermal transfer image-receiving sheets were provided.

(1) Thermal Transfer Image-Receiving Sheet 1

An RC paper (manufactured by Mitsubishi Paper Mills, Ltd.) was provided as a substrate sheet. A coating liquid having the following composition for a heat insulating layer and a coating liquid 1 for a dye-receptive layer each were heated to 40° C. and were then coated by slide coating to a thickness of 12 μm and a thickness of 3 μm, respectively, on a dry basis, followed by cooling at 5° C. for 30 sec. The assembly was then dried at 50° C. for 2 min to obtain a thermal transfer image-receiving sheet 1. Before use, the coating liquids for the following respective compositions were diluted with pure water to a total solid content of 15 to 30%.

| <Coating liquid for heat insulating layer> | |
|---|---|
| Empty particles (volume mean particle diameter: 0.5 μm) (MH5055, manufactured by Zeon Corporation) | 70 parts |
| Gelatin (RP, manufactured by Nitta Gelatin Inc.) | 25 parts |
| Aqueous polyurethane resin (AP40, manufactured by DIC) | 5 parts |

| <Coating liquid 1 for receptive layer> | |
|---|---|
| Vinyl chloride-vinyl acetate-based emulsion (vinyl chloride/vinyl acetate = 97.5/2.5): solid content: 36%) | 411 parts |
| Water dispersion of release agent (solid content: 17%) | 98 parts |
| Epoxy crosslinking agent (EX-512, manufactured by Nagase ChemteX Corporation, solid content: 100%) | 7.6 parts |
| Pure water (for epoxy crosslinking agent dispersion) | 11.4 parts |
| Thickening agent (solid content: 30%) (Adekanol UH-526, manufactured by ADEKA) | 45 parts |
| Pure water (for thickening agent dispersion) | 230 parts |
| Surfactant (aqueous solution of sodium dioctylsulfosuccinate: solid content: 20%) | 23 parts |

The vinyl chloride-based emulsion and the water dispersion of release agent were prepared as follows.

(Synthesis of Vinyl Chloride-Vinyl Acetate-Based Emulsion)

Deionized water (600 g), a monomer mixture composed of 438.8 g of a vinyl chloride monomer (97.5% by weight based on total charge monomer amount), 11.2 g of vinyl acetate (2.5% by weight based on total monomer charge amount), and 2.25 g of potassium persulfate were charged into a 2.5-L autoclave. The reaction mixture was stirred with a stirring blade while maintaining the rotation speed at 120 rpm, and the temperature of the reaction mixture was raised to 60° C. to start a polymerization. A 5% (by weight) aqueous solution of sodium dodecylbenzenesulfonate (180 g, 2% by weight based on total monomer charge amount) was continuously added from the start of the polymerization to 4 hr after the start of the polymerization, and the polymerization was stopped when the polymerization pressure was dropped by 0.6 MPa from a saturated vapor pressure of the vinyl chloride monomer at 60° C. Thereafter, the residual monomer was recovered to obtain a vinyl chloride-vinyl acetate emulsion.

(Preparation of Water Dispersion of Release Agent)

An epoxy-modified silicone (X-22-3000T, manufactured by The Shin-Etsu Chemical Co., Ltd.) (16 g) and 8 g of an aralkyl-modified silicone (X-24-510, manufactured by The Shin-Etsu Chemical Co., Ltd.) were dissolved in 85 g of ethyl acetate. Next, 14 g of a sodium salt of triisopropylnaphthalenesulfonic acid (solid content: 10%) was dissolved in 110 g of pure water. The two solutions prepared above were mixed and stirred, and the mixture was dispersed with a homogenizer to prepare a dispersion. Thereafter, ethyl acetate was removed from the dispersion under the reduced pressure while heating the dispersion to 30 to 60° C. to obtain a water dispersion of silicone.

(2) Thermal Transfer Image-Receiving Sheet 2

A thermal transfer image-receiving sheet 2 was obtained in quite the same manner as in the thermal transfer image-receiving sheet 1, except that the coating liquid 1 for a receptive layer was changed to a coating liquid 2 having the following composition for a receptive layer.

| <Coating liquid 2 for receptive layer> | |
|---|---|
| Vinyl chloride-based resin (Vinyblan 900, manufactured by Nissin Chemical Industry Co., Ltd.) | 80 parts |
| Polyether-modified silicone (KF615A, manufactured by The Shin-Etsu Chemical Co., Ltd.) | 10 parts |
| Gelatin (G-0637K, manufactured by Nitta Gelatin Inc.) | 20 parts |
| Surfactant (Surfynol 440, manufactured by Nissin Chemical Industry Co., Ltd.) | 0.5 part |
| Pure water | 400 parts |

(3) Thermal Transfer Image-Receiving Sheet 3

A thermal transfer image-receiving sheet 3 was obtained in quite the same manner as in the thermal transfer image-receiving sheet 1, except that the coating liquid 1 for a receptive layer was changed to a coating liquid 3 having the following composition for a receptive layer.

| <Coating liquid 3 for receptive layer> | |
|---|---|
| Emulsion (as solid content) | 90 parts |
| Gelatin (as solid content) (RR, manufactured by Nitta Gelatin Inc.) | 10 parts |
| Polyether-modified silicone (KF615A, manufactured by The Shin-Etsu Chemical Co., Ltd.) | 10 parts |
| Surfactant (Surfynol 440, manufactured by Nissin Chemical Industry Co., Ltd.) | 1 part |
| Pure water | 333 parts |

The above emulsions were prepared as follows.

Styrene (121 g), 77 g of ethyl acrylate, and 2 g of acrylic acid as comonomers, and 1.9 g of Aqualon HS-10 (manufactured by Dai-Ichi Kogyo Seiyaku Co., Ltd.) as an emulsifier were placed in a 500-mL (liter) conical flask and were stirred for mixing to prepare a mixture (this mixture will be designated as monomer A). Distilled water (200 g) was placed in a 1-L three-necked flask and was heated to 80° C., and about 20% of the whole amount of the monomer A was added thereto, followed by stirring for 10 min. Thereafter, a solution of 0.4 g of ammonium persulfate dissolved in 20 g of pure water was added, and the mixture was stirred for 10 min, and the remaining 80% of the monomer A was added dropwise through a dropping funnel over a period of 3 hr, followed by stirring for additional 3 hr. Thereafter, the solution was cooled to room temperature and was filtered through a #150 mesh (Nippon Orimono Kako Co., Ltd.) to obtain an emulsion (molecular weight 240000, Tg 50° C.). The molar proportions of styrene and ethyl acrylate were 60% and 40%, respectively, as determined from the molecular weights of styrene and ethyl acrylate and the amounts of styrene and ethyl acrylate used in the reaction.

Evaluation of Prints and Evaluation of Slipping Property

Print evaluation 1 (tailing), print evaluation 2 (post-printing damage), and slipping property evaluation (back surface friction) were carried out in the same manner as in Example 1, except that the thermal transfer sheet used in Example 1 (that is, a thermal transfer sheet prepared using the coating liquid 1 for a heat-resistant slipping layer) was used in combination with the thermal transfer image-receiving sheets 1 to 3 obtained above. The results of evaluation were as shown in Table 4 below.

TABLE 4

| | Thermal transfer sheet | Thermal transfer image-receiving sheet | Evaluation | | |
|---|---|---|---|---|---|
| | | | Tailing | Post-printing damage | Back surface friction |
| Example 12 | Coating liquid 1 for heat-resistant slipping layer | Thermal transfer image-receiving sheet 1 | 4 | 4 | 3 |
| Example 13 | Coating liquid 1 for heat-resistant slipping layer | Thermal transfer image-receiving sheet 2 | 4 | 4 | 3 |
| Example 14 | Coating liquid 1 for heat-resistant slipping layer | Thermal transfer image-receiving sheet 3 | 4 | 4 | 3 |

DESCRIPTION OF REFERENCE CHARACTERS

1 thermal transfer sheet
2 substrate
3 colorant layer
4 heat-resistant slipping layer

The invention claimed is:

1. A thermal transfer sheet comprising: a substrate; a colorant layer provided on one surface of the substrate; and a heat-resistant slipping layer provided on the surface of the substrate opposite to the colorant layer, wherein the heat-resistant slipping layer contains at least a binder resin containing an amino group-containing acrylic resin and an epoxysilane, and a slipping agent.

2. The thermal transfer sheet according to claim 1, wherein the amino group-containing acrylic resin has a glass transition temperature of 30° C. or above.

3. The thermal transfer sheet according to claim 2, wherein the proportion of the amine value (mg KOH/g) of the amino group-containing acrylic resin to the epoxy equivalent (g/eq) of the epoxysilane (amine value/epoxy equivalent) is 0.2 to 3.0.

4. The thermal transfer sheet according to claim 2, wherein the content of the binder resin in the heat-resistant slipping layer is 30 to 90% by weight on a solid content basis.

5. The thermal transfer sheet according to claim 2, wherein the content of the slipping agent in the heat-resistant slipping layer is 5 to 40% by weight on a solid content basis.

6. The thermal transfer sheet according to claim 1, wherein the proportion of the amine value (mg KOH/g) of the amino group-containing acrylic resin to the epoxy equivalent (g/eq) of the epoxysilane (amine value/epoxy equivalent) is 0.2 to 3.0.

7. The thermal transfer sheet according to claim 6, wherein the content of the binder resin in the heat-resistant slipping layer is 30 to 90% by weight on a solid content basis.

8. The thermal transfer sheet according to claim 6, wherein the content of the slipping agent in the heat-resistant slipping layer is 5 to 40% by weight on a solid content basis.

9. The thermal transfer sheet according to claim 1, wherein the content of the binder resin in the heat-resistant slipping layer is 30 to 90% by weight on a solid content basis.

10. The thermal transfer sheet according to claim 9, wherein the content of the slipping agent in the heat-resistant slipping layer is 5 to 40% by weight on a solid content basis.

11. The thermal transfer sheet according to claim 1, wherein the content of the slipping agent in the heat-resistant slipping layer is 5 to 40% by weight on a solid content basis.

* * * * *